US006293510B1

(12) United States Patent
Bradford et al.

(10) Patent No.: US 6,293,510 B1
(45) Date of Patent: Sep. 25, 2001

(54) LUMINAIRE MOUNTING BRACKET

(75) Inventors: Reed A. Bradford, Hendersonville; James H. Toney, Canton, both of NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/514,610

(22) Filed: Feb. 28, 2000

(51) Int. Cl.[7] ..... F21V 21/00

(52) U.S. Cl. ..... 248/317; 248/342; 248/344; 248/906; 248/343; 362/371; 362/374; 362/375

(58) Field of Search ..... 248/288.11, 291.1, 248/320, 342, 344, 906; 362/371, 374, 375, 576, 581

(56) References Cited

U.S. PATENT DOCUMENTS

| | | | | |
|---|---|---|---|---|
| 4,200,905 | * | 4/1980 | Shelby et al. | 362/396 |
| 4,219,869 | * | 8/1980 | Bowman et al. | 362/147 |
| 4,422,659 | * | 12/1983 | Nebu | 280/152.1 |
| 6,033,097 | * | 3/2000 | Harwood | 362/404 |

OTHER PUBLICATIONS

*Gardco Quatra GP1* Catalogue, Gardco, date unknown, p. 14.

*Kim Lighting* Catalogue Pages, Kim Lighting, date unknown, pp. 2–3.

*Garage–Gard Luminaire* Catalogue Page, General Electric Company, Jan. 1998, p. 191.

* cited by examiner

*Primary Examiner*—Leslie A. Braun
*Assistant Examiner*—S M M
(74) *Attorney, Agent, or Firm*—Fay, Sharpe, Fagan, Minnich & McKee, LLP

(57) ABSTRACT

An apparatus and method for mounting luminaires (A) includes a lower mounting plate (30*a*) having a front face (32*a*) and a back face (34*a*) adapted for attachment to a luminaire. An upper mounting plate (30*b*), having a front face (32*b*) and a back face (34*b*), is adapted for attachment to an electrical assembly (20). The upper and lower mounting plates are identical in configuration. The upper mounting plate selectively engages the lower mounting plate so that the upper mounting plate and the lower mounting plate are in locking relation. A hinge (50) operatively connects the upper and lower mounting plates. The hinge is adapted to swing down and suspend the luminaire while the appropriate electrical connections are made and pivot to a substantially horizontal position once the upper and lower mounting plates have been placed in locking relation.

20 Claims, 4 Drawing Sheets

LUMINAIRE MOUNTING BRACKET

BACKGROUND OF THE INVENTION

1. Field of the Invention

This invention pertains to an apparatus and method for improving the performance of mounting brackets for lighting fixtures. More particularly, this invention relates to a thin profiled mounting bracket, for permanently mounting luminaires to a junction box, which is capable of suspending a luminaire during installation and deterring vandalism and theft upon completion of installation.

2. Discussion of the Art

Luminaires have a number of applications and are widely used for architectural and outdoor lighting, as well as indoor lighting applications. For example, streets, sidewalks, and parking lots often require luminaires to provide adequate lighting. A conventional luminaire includes a housing for enclosing and protecting electrical components of the luminaire. Electrical wires typically extend from a portion of the luminaire for connection to an electrical junction box, commonly referred to as a J-box. The electrical junction box is mounted to any structure requiring a lighting fixture, such as a ceiling of a parking garage, a post on a street, or a tree in a park. Once the appropriate wire connections are made, the luminaire is mounted to the junction box through a mounting assembly. Known devices for mounting a luminaire to an electrical junction box include a bracket secured to the luminaire which is adapted to fit over and attach to the junction box through the use of fasteners.

Luminaires designed for use in large areas, such as underground parking garages, parks, and highways, are relatively heavy and cumbersome. In addition, luminaires and their associated circuitry are usually located at substantial heights above the ground. As such, two people are generally required to mount the luminaire to the junction box. The first person holds the luminaire in position while the other person completes the electrical connection and secures the bracket to the junction box. In addition, routine repair, maintenance, and adjustment procedures often require two people to perform work on a heavy luminaire. With the cost of labor rapidly escalating, especially for commercial construction workers, the use of known mounting devices for luminaires has become expensive.

Adding to the expense of maintaining luminaires are costs associated with vandalism, theft, and inadvertent damage caused by unstable mounting mechanisms. Because luminaires are used in exposed public environments where security is minimal, they are prone to theft and vandalism. Furthermore, luminaires often undergo elevated levels of vibration, such as that generated by inadvertent bumping or heavy vehicles traveling in a parking garage. The vibration may disturb the attachment of the luminaire to its mounting device.

In order to alleviate the foregoing problems associated with conventional mounting devices, one known mounting bracket has hooks extending therefrom. The bracket is mounted to a junction box and the hooks are adapted to penetrate the housing of the luminaire and suspend the luminaire while the electrical connections are made. After the electrical connections have been made, the hooks are received in pockets of the luminaire. At this point, the fixture is locked to the junction box and cannot be removed without internal access through the ballast compartment.

There are a number of significant shortcomings associated with the foregoing mounting device. First, the hooks that suspend the luminaire during installation penetrate directly into the housing once the luminaire has been permanently mounted. This creates a potential undesired path for water and moisture to enter the fixture thereby causing early luminaire failure. Second, this device is complex having a number of different parts that are expensive to manufacture. Moreover, the mounting bracket is relatively large and bulky having a thick profile.

Thus, a need exists to provide a thin profiled mounting bracket capable of suspending a luminaire during installation, deterring theft and vandalism, preventing water from penetrating the luminaire housing, and that is economical to manufacture and use.

BRIEF SUMMARY OF THE INVENTION

A new and improved apparatus and method is provided for mounting luminaires that meet the foregoing needs.

An exemplary embodiment inventive luminaire mounting bracket includes a first or lower mounting plate having a first or front surface and a second or back surface adapted for attachment to a luminaire. A second or upper mounting plate has a first or front surface and a second or back surface adapted for attachment to an electrical assembly. The upper mounting plate selectively engages the lower mounting plate so that the upper mounting plate and the lower mounting plate are in locking relation, thereby forming a thin profile. A hinge operatively connects the upper mounting plate and the lower mounting plate. The hinge is adapted to suspend the luminaire while the appropriate electrical connections are made and before the upper and lower mounting plates are brought into locking relation.

The luminaire mounting bracket preferably includes upper and lower identical mounting plates adapted to mate together in locking relation.

An exemplary method for installing a luminaire in a hands-free mode includes mounting an upper mounting plate to an electrical box. A lower mounting plate is mounted to a housing of the luminaire. The upper mounting plate and the lower mounting plate are interconnected via a hinge adapted to suspend the luminaire during installation and maintenance operations. Electrical wires protruding from the housing of the luminaire are coupled to electrical wires extending from the electrical box. The hinge is collapsed and the upper and lower mounting plates are placed in locking relation.

One advantage of the present invention is the provision of a mounting bracket for a luminaire capable of suspending the luminaire during installation and routine maintenance.

Another advantage of the present invention resides in the ability of the mounting bracket to deter vandalism and theft.

Still another advantage of the present invention is the provision of a mounting bracket which does not penetrate the housing of the luminaire.

Still another advantage of the present invention is the provision of a mounting bracket having a reduced number of components and identical mounting plates thus significantly reducing manufacturing costs.

Yet another advantage of the present invention is the provision of a mounting bracket having a thin profile.

DETAILED DESCRIPTION OF THE INVENTION

Figure 1:
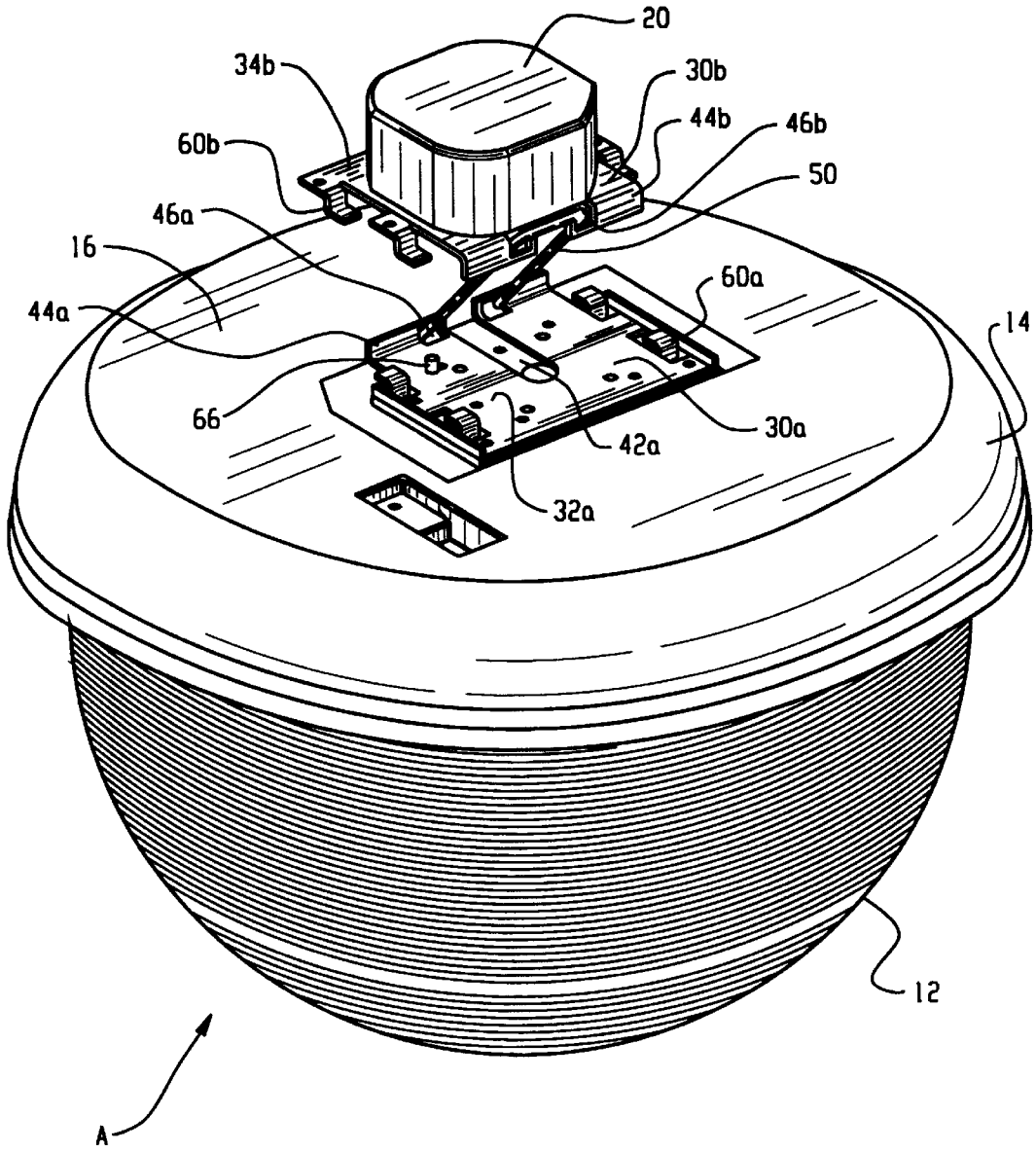
FIG. 1 is a perspective view of a mounting bracket in accordance with the present invention operatively connecting a luminaire to a junction box in suspended relation

FIG. 1 shows a luminaire A in accordance with the present invention. The luminaire A includes a translucent housing, such as a polycarbonate window or lens 12 and a housing 14 enclosing the electrical components of the lamp. The lens and housing direct light into a bounded area in a manner well known in the art. The illustrated housing has smooth contours and a substantially planar top surface 16, although it will be appreciated that a number of different housing styles can be used without departing from the scope and intent of the invention. A first set of electrical wires (not shown) extend from the interior of the housing 14 through the planar top surface of the housing.

An electrical assembly, such as a junction box or J-box 20, operates to provide electrical power to the luminaire A. The junction box 20 may be mounted in any number of environments where illumination is required, such as a parking garage, street, or park. In order to provide power to the luminaire, a second set of electrical wires (not shown) extend from a conduit (not shown) into the junction box 20 and are adapted for electrical connection to the first set of electrical wires of the luminaire. Thus, electrical power is transmitted from the junction box 20 to the luminaire. Although FIG. 1 shows a junction box having a particular size and shape, it will be appreciated that any conventional electrical assembly or junction box may be used without departing from the scope and intent of the present invention.

Figure 2:
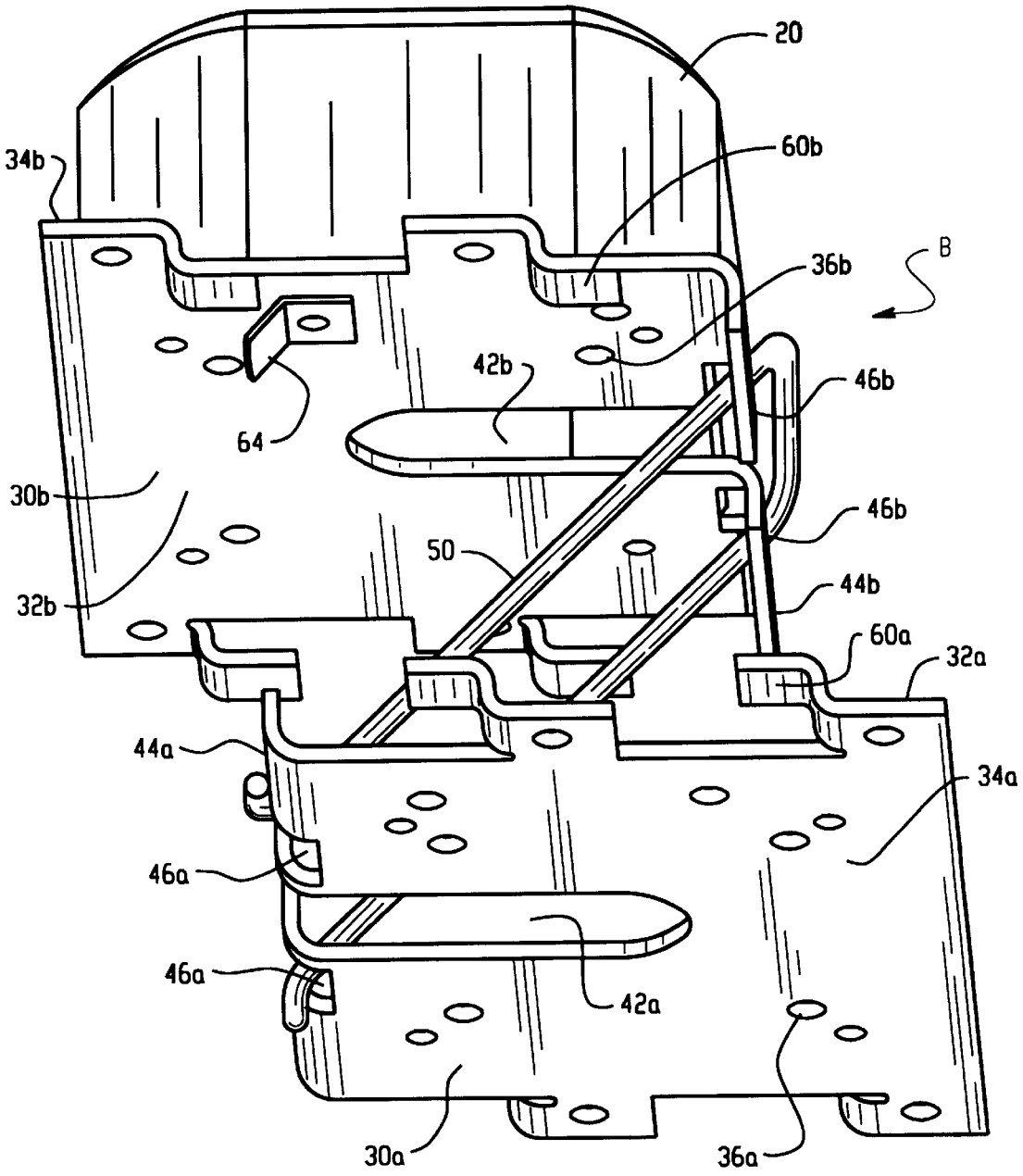
FIG. 2 is a perspective view of the mounting bracket of FIG. 1 operatively connected to a junction box.

With continued reference to FIG. 1, and further reference to FIG. 2, a low profile mounting assembly or bracket B suspends the luminaire A while the electrical connections are being made, thereby eliminating the need for the installer to hold the fixture while also making the electrical connections. Thus, only one person is needed to install and perform work on the luminaire since the bracket advantageously supports or suspends the luminaire and provides a hands-free mode of operation. After the appropriate electrical connections have been made, the bracket B collapses into a thin profile. In the collapsed position, the bracket functions to effectively mount the luminaire A to the junction box 20 in such a manner that theft, vandalism, and inadvertent detachment are minimized.

FIGS. 1 and 2 show the bracket B in its original, uncollapsed position. The bracket includes a first or lower mounting plate 30*a* which is operatively connected to the top planar surface 16 of the housing 14. A second or upper mounting plate 30*b* is operatively connected to the junction box 20. In the preferred embodiment, the mounting plates 30*a*, 30*b* are identical thereby significantly reducing the cost of manufacturing the bracket. Since the mounting plates are identical, like components will be identified by like numerals with an "a" or "b" suffix for ease of reference to the first and second mounting plates 30*a*, 30*b*, respectively. Each mounting plate has a first or front face 32*a*, 32*b*, respectively and a second or back face 34*a*, 34*b*, respectively. The back face 34*a* of the lower mounting plate 30*a* is oriented for direct, abutting engagement with the luminaire housing top surface 16, while the back face 34*b* of the upper mounting plate 30*b* is oriented for direct, abutting engagement with a bottom surface of the junction box 20. Thus, the front face 32*a*, 32*b* of each mounting plate is disposed in facing relation to one another.

The mounting plates 30*a*, 30*b* include a series of mounting holes 36*a*, 36*b* for receiving fasteners (not shown). The fasteners attach the lower mounting plate 30*a* to the luminaire A and the upper mounting plate 30*b* to the junction box 20. Any conventional fasteners may be used in conjunction with the present invention. The fasteners that connect the lower mounting plate to the luminaire preferably do not pass into the housing of the luminaire. Instead, bosses or blind end recesses (not shown) are provided in the housing for receiving the fasteners to limit the number of openings (and potential leak paths) into the housing. As such, this structural feature simultaneously saves on space required for the mounting bracket and does not provide a path for water ingress or pooling as noted above.

Each mounting plate 30*a*, 30*b* further includes a slot 42*a*, 42*b* which allows the electrical wires to pass from the luminaire A, through the bracket B, and into the junction box 20. Alternatively, each mounting plate may include an embossed section having a hole punched therethrough for allowing the electrical wires to pass through the bracket. Each mounting plate further includes at least one lip 44*a*, 44*b* extending in substantially perpendicular relation from an edge of the mounting plate. In the illustrated embodiment, two lips are shown in each mounting plate which are separated by the slot 42*a*, 42*b*. The lips 44*a*, 44*b* of each mounting plate include a set of apertures 46*a*, 46*b* for reasons that will become more apparent below.

Figure 3:
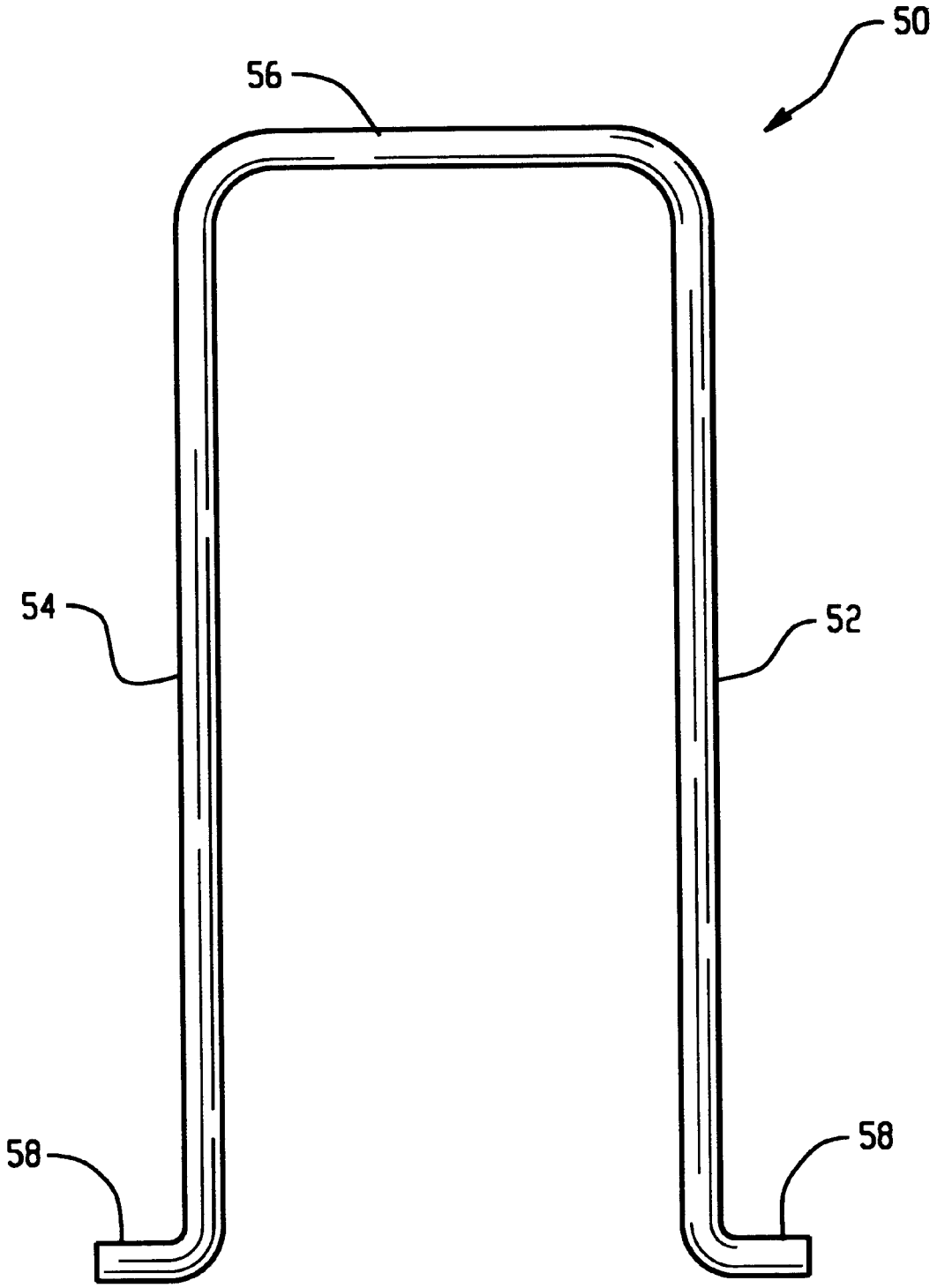
FIG. 3 is a plan view of a hinge in accordance with the teachings of the present invention.

With continued reference to FIGS. 1 and 2, and further reference to FIG. 3, a substantially U-shaped hinge 50 functions to connect the lower and upper mounting plates 30*a*, 30*b* together. The U-shaped hinge has a pair of legs 52, 54 disposed in generally parallel relation interconnected by a bridge 56. An end 58 of each leg 52, 54 projects outwardly so that the legs form the shape of an "L", although it will be understood that still other angles or shapes can be used without departing from the scope and intent of the present invention. In the exemplary embodiment, the hinge is made from an elastic wire material. As such, the L-shaped legs can be pressed together allowing them to be inserted through both sets of apertures 46*a*, 46*b* defined by the lips 44*a*, 44*b* of each mounting plate. After the legs have been inserted through both sets of apertures, the L-shaped ends expand thereby locking the hinge to the lower mounting plate 30*a*. At this point, the bracket is in an uncollapsed position (i.e., the mounting plates are secured together via the hinge) and the mounting plates are disposed in spaced relation and capable of suspending the luminaire without any additional structure. This allows a single installer to easily make the appropriate electrical connections once the luminaire is suspended from the junction box via the mounting bracket.

Figure 4:
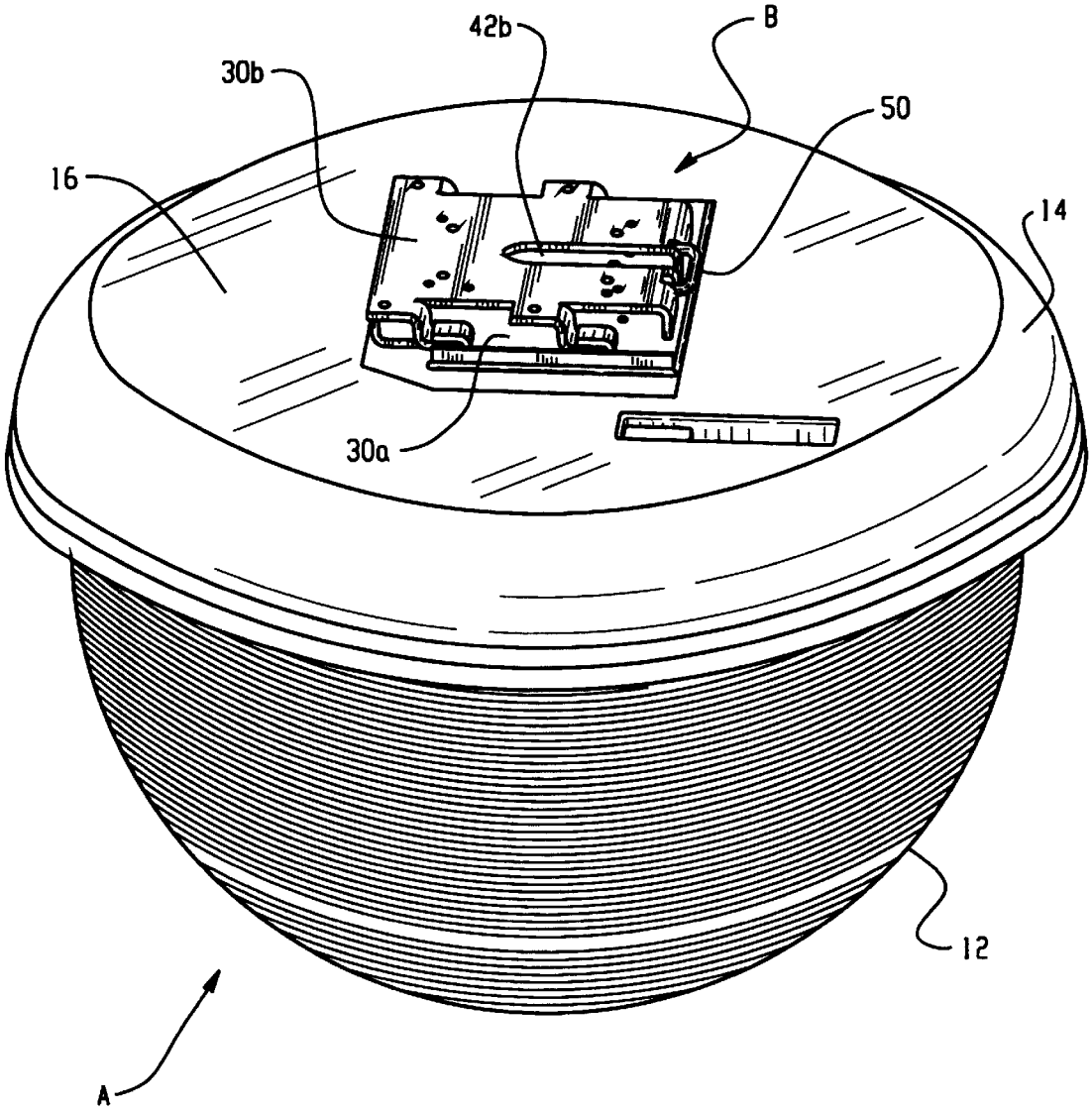
FIG. 4 is a perspective view of a mounting bracket in a collapsed position operatively connected to a luminaire.

Once the electrical connections have been made, the hinge 50 is pivoted so that the mounting plates 30*a*, 30*b* are brought together from the orientation shown in FIGS. 1 and 2 to form a thin profile with the hinge disposed between the two mounting plates as shown in FIG. 4. In order to secure the mounting plates together, the mounting plates each have a series of fingers 60*a*, 60*b* offset from the remainder of the plane of the mounting plates. The fingers 60*a* of the lower mounting plate 30*a* are adapted to slide into a mating relationship with the fingers 60*b* of the upper mounting plate 30*b*. To prevent the fingers from disengaging, a spring clip 64 (see FIG. 2) is mounted on the upper mounting plate 30*b*. When the mounting plates are slid together, the spring clip passes over a screw 66 (see FIG. 1) protruding from the lower mounting plate 30*a*. Once the spring clip passes the screw, the mounting plates are locked into place and can only be unlocked by retracting or backing out the screw.

Thus, vandalism, theft, and accidental detachment are minimized since the screw 66 is accessible from inside the luminaire only. The bracket in its fully collapsed position is best seen in FIG. 4 with the electrical box omitted for ease of illustration.

In operation, the lower mounting plate 30*a* is attached to the luminaire A and the upper mounting plate 30*b* is attached to the junction box 20. The L-shaped legs of the hinge 50 are then inserted through both sets of apertures 46*a*, 46*b* of each mounting plate thereby connecting the luminaire to the junction box via the bracket B. As such, the luminaire is suspended which allows the electrical connections to be made without having to manually support the luminaire. Once the appropriate electrical connections have been made, the upper and lower mounting plates are slid together so that the fingers 60*a*, 60*b* of each mounting plate are in mating relation as described above. While the mounting plates are slid together, the spring clip 64 slides over the protruding screw 66 so that the two mounting plates are locked together. In order to disengage the mounting plates from locking relation, the screw must be backed out from inside the luminaire.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents.

What is claimed is:

1. A luminaire mounting bracket for securing a luminaire to an electrical box, the mounting bracket comprising:

a first mounting plate having opposed first and second surfaces, the first surface adapted for attachment to a luminaire.

a second mounting plate having opposed first and second surfaces, the first surface adapted for attachment to an electrical box; and a hinge operatively connecting the first and second mounting plates, the hinge interconnecting the mounting plates in a first, spaced relation adapted to suspend the luminaire while the appropriate electrical connections are made before the upper and lower mounting plates are placed in locking relation, and the second mounting plate selectively engaging the first mounting plate so that the upper mounting plate and the lower mounting plate are in locking relation, thereby forming a thin profile.

2. A luminaire mounting bracket according to claim 1, wherein the hinge collapses to a substantially planar position between the first and second mounting plates once the first and second mounting plates have been placed in locking relation.

3. A luminaire mounting bracket according to claim 1, wherein the first and second mounting plates are identical.

4. A luminaire mounting bracket according to claim 1, wherein the first and second mounting plates each include a slot for allowing associated electrical components to extend from the associated luminaire, through the mounting bracket, and into the electrical box.

5. A luminaire mounting bracket according to claim 1, wherein the first and second mounting plates each have a plurality of fingers that selectively slide into engagement with one another, thereby placing the first and second mounting plates in mating relation.

6. A luminaire mounting bracket according to claim 1, wherein one of the first and second mounting plates includes a spring clip adapted to slide over a screw protruding from the other of the first and second mounting plates thereby locking the mounting plates together.

7. A luminaire mounting bracket according to claim 6, wherein the first and second mounting plates can only be disengaged from locking relation by retracting the screw protruding from the other of the first and second mounting plates, the screw being accessible only from inside the luminaire.

8. A luminaire mounting bracket according to claim 1, wherein the first and second mounting plates each include at least one lip having a set of apertures.

9. A luminaire mounting bracket according to claim 8, wherein the hinge is formed from first and second L-shaped legs interconnected by a bridge, the L-shaped legs formed from an elastic material and adapted to be inserted through each set of apertures in the lip of the first and second mounting plates thereby interconnecting the first and second mounting plates.

10. A luminaire mounting bracket according to claim 1, wherein the second mounting plate is adapted to be mounted to the associated luminaire with fasteners that do not penetrate into the luminaire, thereby preventing water ingress and pooling.

11. A luminaire mounting bracket according to claim 1, wherein the hinge is substantially U-shaped.

12. A luminaire mounting bracket comprising:

upper and lower substantially identical mounting plates adapted to mate together in locking relation, the upper mounting plate mounted to an electrical assembly and the lower mounting plate mounted to a housing of a luminaire; and a pivotable hinge operatively connecting the upper mounting plate and the lower mounting plate, the hinge suspending the luminaire while the appropriate electrical connections are made and pivoting up to a substantially horizontal position once the upper and lower mounting plates have been placed in locking relation.

13. A luminaire mounting bracket according to claim 12, wherein the upper mounting plate and lower mounting plate each include a slot for allowing associated electrical components to extend from the luminaire, through the mounting bracket, and into the electrical assembly.

14. A luminaire mounting bracket according to claim 12, wherein the upper mounting plate and lower mounting plate each have a plurality of fingers, the fingers of the upper mounting plate selectively sliding into engagement with the fingers of the lower mounting plate, thereby placing the upper and lower mounting plates in mating relation.

15. A luminaire mounting bracket according to claim 12, wherein the upper mounting plate includes a spring clip adapted to slide over a screw protruding from the lower mounting plate thereby locking the upper and lower mounting plates together.

16. A luminaire mounting bracket according to claim 15, wherein the upper and lower mounting plates can only be disengaged from locking relation by retracting the screw from the lower mounting plate, the screw being accessible only from inside the luminaire thereby minimizing theft and vandalism.

17. A luminaire mounting bracket according to claim 16, wherein the hinge is formed from first and second L-shaped legs interconnected by a bridge, the L-shaped legs formed from an elastic material and adapted to be inserted through each set of apertures in the lip of the upper and lower mounting plates, thereby interconnecting the upper and lower mounting plates.

18. A luminaire mounting bracket according to claim 12, wherein the lower mounting plate is mounted to a housing of the luminaire with fasteners that do not penetrate through the housing of the luminaire, thereby preventing water ingress and pooling.

19. A method for installing a luminaire in a hands-free mode comprising the steps of:

mounting an upper mounting plate to an electrical assembly;

mounting a lower mounting plate to a housing of the luminaire; interconnecting the upper mounting plate and lower mounting plate via a hinge adapted to suspend the luminaire during installation and maintenance operations;

coupling electrical wires protruding from the housing of the luminaire to electrical wires extending from the electrical assembly; and collapsing the hinge and placing the upper and lower mounting plates in locking relation.

20. The method according to claim 19, wherein the interconnecting step includes:

inserting first and second L-shaped legs of the hinge into a set of apertures defined by the upper mounting plate; and inserting the L-shaped legs of the hinge into a set of apertures defined by the lower mounting plate.

* * * * *